US010254670B2

(12) United States Patent
Uchihashi

(10) Patent No.: US 10,254,670 B2
(45) Date of Patent: Apr. 9, 2019

(54) ELECTROSTATIC LATENT IMAGE DEVELOPING TONER AND TONER EXTERNAL ADDITIVE

(71) Applicant: KYOCERA Document Solutions Inc., Osaka (JP)

(72) Inventor: Yuma Uchihashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/933,661

(22) Filed: Mar. 23, 2018

(65) Prior Publication Data

US 2018/0284630 A1 Oct. 4, 2018

(30) Foreign Application Priority Data

Mar. 28, 2017 (JP) ..... 2017-062637

(51) Int. Cl.

| | |
|---|---|
| ***G03G 9/087*** | (2006.01) |
| ***G03G 9/08*** | (2006.01) |
| ***G03G 15/08*** | (2006.01) |
| ***G03G 9/097*** | (2006.01) |

(52) U.S. Cl.

CPC ..... *G03G 9/08728* (2013.01); *G03G 9/0819* (2013.01); *G03G 9/0825* (2013.01); *G03G 9/097* (2013.01); *G03G 9/09775* (2013.01); *G03G 15/0865* (2013.01)

(58) Field of Classification Search

CPC ..... G03G 9/09775; G03G 9/08728; G03G 9/097; G03G 9/0825

USPC ..... 430/108.22

See application file for complete search history.

(56) References Cited

U.S. PATENT DOCUMENTS

| | | | | |
|---|---|---|---|---|
| 4,415,646 | A * | 11/1983 | Gruber | G03G 9/08726 430/108.22 |
| 5,098,811 | A * | 3/1992 | Anno | C07F 3/003 430/108.21 |
| 7,881,648 | B2 * | 2/2011 | Yoshida | G03G 9/08722 399/286 |
| 2003/0108808 | A1 * | 6/2003 | Inoue | G03G 9/0808 430/108.8 |
| 2006/0269861 | A1 * | 11/2006 | Hirano | G03G 9/0804 430/110.2 |

(Continued)

FOREIGN PATENT DOCUMENTS

| | | | |
|---|---|---|---|
| CA | 2534306 | A1 * | 7/2006 |
| JP | 2008-233341 | A | 10/2008 |

(Continued)

OTHER PUBLICATIONS

English language machine translation of JP 2015-055857 (Mar. 2015).*

*Primary Examiner* — Christopher D Rodee

(74) *Attorney, Agent, or Firm* — Studebaker & Brackett PC

(57) ABSTRACT

An electrostatic latent image developing toner includes a plurality of toner particles each including a toner mother particle and an external additive attached to a surface of the toner mother particle. The external additive includes a plurality of resin particles each containing first temperature responsive polymer domains and second temperature responsive polymer domains. The second temperature responsive polymer domains have a lower critical solution temperature (LCST) higher than that of the first temperature responsive polymer domains.

6 Claims, 3 Drawing Sheets

(56) References Cited

U.S. PATENT DOCUMENTS

| | | | | |
|---|---|---|---|---|
| 2012/0189953 | A1* | 7/2012 | Tujihiro | G03G 9/081<br>430/108.22 |
| 2014/0287354 | A1* | 9/2014 | Kawamura | G03G 9/0825<br>430/109.3 |

FOREIGN PATENT DOCUMENTS

| | | | | | |
|---|---|---|---|---|---|
| JP | 2011170199 | A | * | 9/2011 | |
| JP | 2015055857 | A | * | 3/2015 | |
| WO | WO-2017059312 | A1 | * | 4/2017 | A23G 4/08 |

* cited by examiner

ELECTROSTATIC LATENT IMAGE DEVELOPING TONER AND TONER EXTERNAL ADDITIVE

INCORPORATION BY REFERENCE

The present application claims priority under 35 U.S.C. § 119 to Japanese Patent Application No. 2017-062637, filed on Mar. 28, 2017. The contents of this application are incorporated herein by reference in their entirety.

BACKGROUND

The present disclosure relates to an electrostatic latent image developing toner and a toner external additive.

It is a known technique for magnetic substance-dispersed resin carriers to form on surfaces of carrier cores (core particles) coat layers containing a temperature responsive macromolecule (specifically, a vinyl polymer) essentially containing either or both N-isopropyl acrylamide and N-isopropyl methacrylamide.

SUMMARY

An electrostatic latent image developing toner according to an aspect of the present disclosure includes a plurality of toner particles each including a toner mother particle and an external additive attached to a surface of the toner mother particle. The external additive includes a plurality of resin particles each containing first temperature responsive polymer domains and second temperature responsive polymer domains. The second temperature responsive polymer domains have a lower critical solution temperature higher than that of the first temperature responsive polymer domains.

A toner external additive according to another aspect of the present disclosure includes a plurality of resin particles each containing first temperature responsive polymer domains and second temperature responsive polymer domains. The second temperature responsive polymer domains have a lower critical solution temperature higher than that of the first temperature responsive polymer domains.

DETAILED DESCRIPTION

Figure 1:
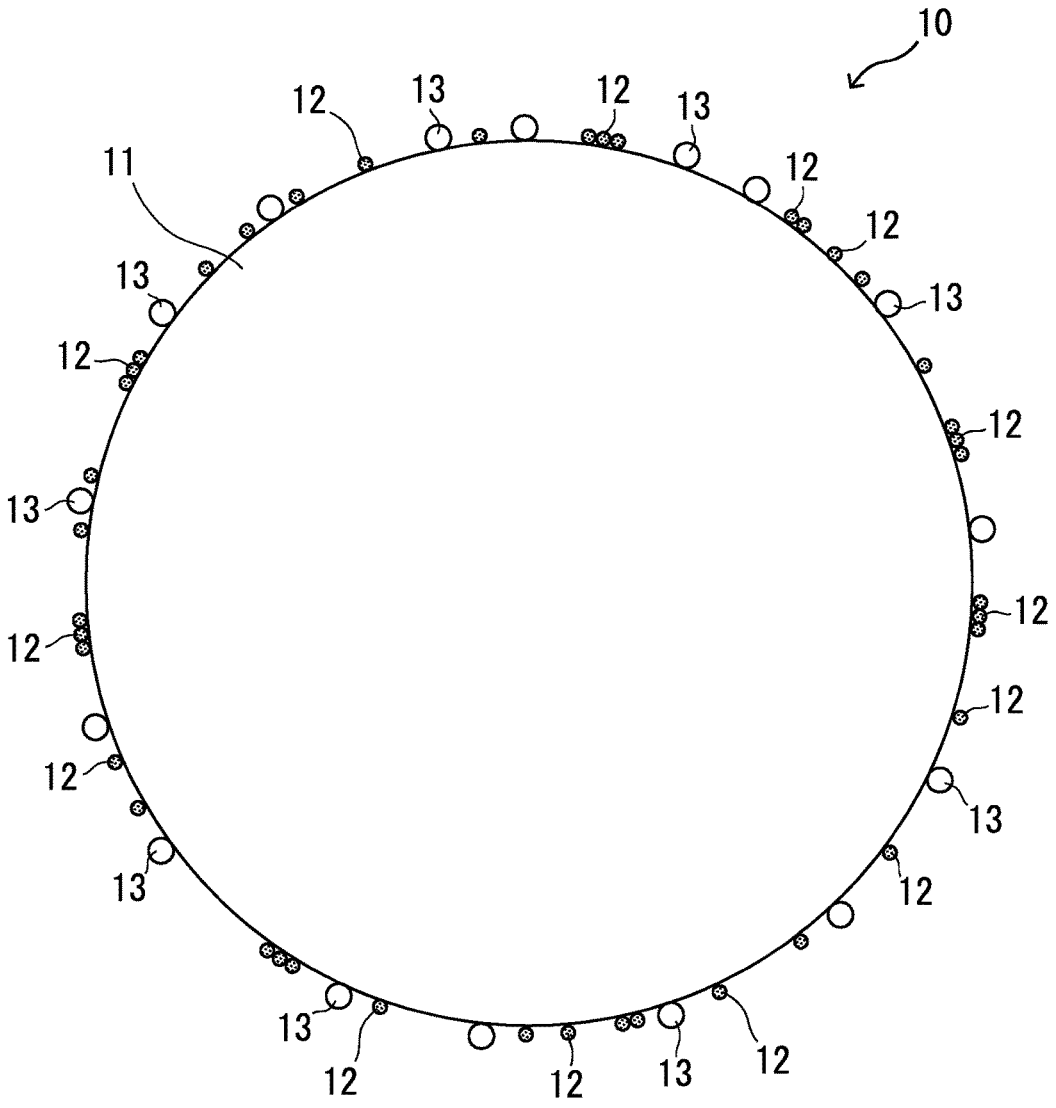
FIG. 1 is a diagram illustrating an example of a sectional structure of a toner particle included in an electrostatic latent image developing toner according to an embodiment of the present disclosure.

An embodiment of the present disclosure will be described below. Note that evaluation results (values indicating shape, physical properties, or the like) for a powder (specific examples include toner mother particles, an external additive, or a toner) are number average values measured for an appropriate number of particles unless otherwise stated.

Unless otherwise stated, the number average particle diameter of a powder is a number average value of equivalent circle diameters (i.e., Heywood diameters: equivalent diameters of circles having the same areas as the projected areas of respective particles) of primary particles measured using a microscope. A measured value of the volume median diameter ($D_{50}$) of a powder is a value measured using a laser diffraction/scattering particle size distribution analyzer ("LA-750" produced by Horiba, Ltd.) unless otherwise stated.

Unless otherwise stated, a glass transition point (Tg) is a value measured using a differential scanning calorimeter ("DSC-6220" produced by Seiko Instruments Inc.) in accordance with "Japanese Industrial Standard (JIS) K7121-2012". On a heat absorption curve (vertical axis: heat flow (DSC signal), horizontal axis: temperature) measured using the differential scanning calorimeter, a temperature (i.e., onset temperature) of an inflection point (i.e., an intersection point of an extrapolation of a base line and an extrapolation of an inclined portion of the curve) due to glass transition corresponds to the glass transition point (Tg). Values for molecular weight (specific examples include a number average molecular weight and a mass average molecular weight) are values measured by gel permeation chromatography unless otherwise stated.

Chargeability refers to chargeability in triboelectric charging unless otherwise stated. A level of positive chargeability (or negative chargeability) in triboelectric charging can be determined for example using a known triboelectric series.

A "main component" of a material refers to a component contained the most in the material in terms of mass unless otherwise stated.

In the present description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. In the present description, the term "(meth)acryl" is used as a generic term for both acryl and methacryl. Also, acrylonitrile and methacrylonitrile may be referred collectively to as "(meth)acrylonitrile".

In the present description, both untreated silica particles (also referred to below as silica base) and silica particles obtained through surface treatment on the silica base (surface-treated silica particles) are referred to as "silica particles". Silica particles hydrophobized with a surface treatment agent may be referred to as "hydrophobic silica particles", and silica particles to which positive chargeability is imparted with a surface treatment agent may be referred to as "positively chargeable silica particles".

A toner according to the present embodiment can be favorably used for example as a positively chargeable toner for development of electrostatic latent images. The toner according to the present embodiment is a powder including a plurality of toner particles (particles each having later-described features). The toner may be used as a one-component developer. Alternatively, a two-component developer may be prepared by mixing the toner with a carrier using a mixer (e.g., a ball mill). A ferrite carrier (powder of ferrite particles) is an example of a carrier suitable for image formation. In order that a high-quality image durable for a long period of time is formed, it is preferable to use magnetic carrier particles each including a carrier core and a resin layer covering the carrier core. It is preferable that the resin layer entirely covers a surface of the carrier core (i.e., there is no surface region of the carrier core exposed through the resin layer) in order to ensure a sufficient property of the carrier for charging the toner for a long period of time. In order to magnetize the carrier particles, the carrier cores may be made from a magnetic material (e.g., a ferromagnetic material such as ferrite) or a resin in which magnetic particles are dispersed. Alternatively, magnetic particles may be dispersed in the resin layer covering the carrier core. Examples of resins forming the resin layers include at least one type of resin selected from the group consisting of fluororesins (specific examples include perfluoroalkoxy alkane (PFA) and fluorinated ethylene propylene (FEP)), polyimide-imide resins, silicone resins, urethane resins, epoxy resins, and phenolic resins. The amount of the toner in the two-component developer is preferably at least 5 parts by mass and no greater than 15 parts by mass relative to 100 parts by mass of the carrier in order that high-quality images are formed. The carrier preferably has a number average primary particle diameter of at least 20 μm and no greater than 120 μm. A positively chargeable toner contained in a two-component developer is positively charged by friction with a carrier. By contrast, a negatively chargeable toner contained in a two-component developer is negatively charged by friction with a carrier.

The toner according to the present embodiment can be used for example for image formation using an electrophotographic apparatus (image forming apparatus). The following describes an example of an image forming method using an electrophotographic apparatus.

An image forming section (e.g., a charger and a light exposure device) of the electrophotographic apparatus forms an electrostatic latent image on a photosensitive member (e.g., a surface portion of a photosensitive drum) based on image data. Subsequently, a development device (specifically, a development device loaded with developer containing toner) of the electrophotographic apparatus supplies the toner to the photosensitive member to develop the electrostatic latent image formed on the photosensitive member. The toner is charged by friction with a carrier, a development sleeve, or a blade in the development device before being supplied to the photosensitive member. For example, a positively chargeable toner is charged positively. In a development process, a toner image is formed on the photosensitive member in a manner that toner (specifically, charged toner) on the development sleeve (e.g., a surface portion of a development roller in the development device) located near the photosensitive member is supplied to the photosensitive member and the supplied toner is attached to a portion of the electrostatic latent image exposed to light on the photosensitive member. The development device is replenished with toner in an amount equivalent to that of toner consumed in the development process from a toner container loaded with toner for replenishment use.

In a subsequent transfer process, a transfer device of the electrophotographic apparatus transfers the toner image on the photosensitive member to an intermediate transfer member (e.g., a transfer belt) and further transfers the toner image on the intermediate transfer member to a recording medium (e.g., paper). Thereafter, a fixing device (fixing method: nip fixing using a heating roller and a pressure roller) of the electrophotographic apparatus applies heat and pressure to the toner to fix the toner to the recording medium. As a result, an image is formed on the recording medium. For example, a full color image can be formed by superimposing toner images in four colors of black, yellow, magenta, and cyan. Residual toner on the photosensitive member after the transfer process is removed by a cleaning member (e.g., a cleaning blade). The transfer process may be a direct transfer process by which the toner image on the photosensitive member is directly transferred to the recording medium not via the intermediate transfer member. The fixing method may be a belt fixing method.

The toner according to the present embodiment is an electrostatic latent image developing toner having the following features (also referred to below as basic features).

(Basic Features of Toner)

The electrostatic latent image developing toner includes a plurality of toner particles each including a toner mother particle and an external additive attached to a surface of the toner mother particle. The external additive includes a plurality of resin particles each containing first temperature responsive polymer domains and second temperature responsive polymer domains. The second temperature responsive polymer domains have a lower critical solution temperature (LCST) higher than that of the first temperature responsive polymer domains. In the present description, the first temperature responsive polymer domains may be referred to as "low TR domains" and the second temperature responsive polymer domains may be referred to as "high TR domains". A LCST measuring method is the same as that described later in Examples or an alternative method thereof.

In the above basic features, the resin particles contain a resin as a major component of the resin particles (also referred to below as an "external additive resin") in addition to the low TR domains and the high TR domains. The external additive resin, the low TR domains, and the high TR domains are integrated to constitute each of the resin particles.

Figure 2:
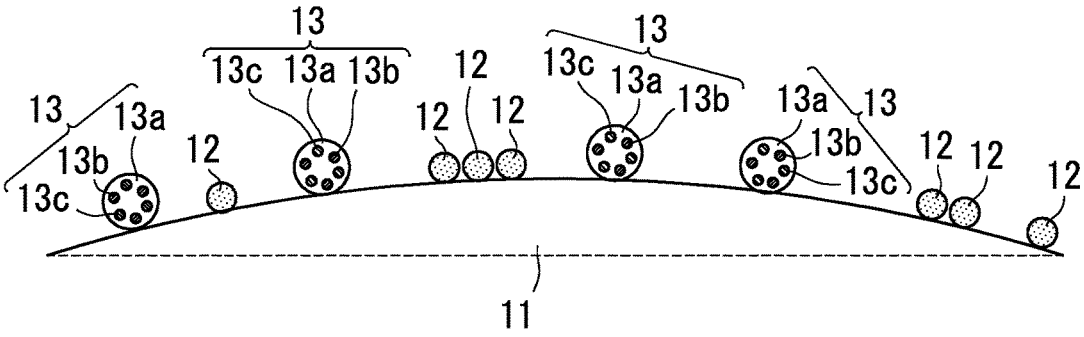
FIG. 2 is a diagram illustrating in an enlarged scale a part of a surface of the toner particle illustrated in FIG. 1.

The following describes an example of the toner particles included in the toner having the above basic features with reference to FIGS. 1 and 2.

A toner particle 10 illustrated in FIG. 1 includes a toner mother particle 11 and an external additive attached to a surface of the toner mother particle 11. The external additive includes a plurality of inorganic particles 12 (e.g., silica particles) and a plurality of resin particles 13 (specifically, the resin particles defined in the basic features). The inorganic particles 12 and the resin particles 13 are attached to the surface of the toner mother particle 11 for example by either or both of Van der Waals force and static electricity.

As illustrated in FIG. 2, each of the resin particles 13 contains an external additive resin 13*a*, first domains 13*b*, and second domains 13*c*. The external additive resin 13*a* functions as a binder resin in the resin particle 13. The first domains 13*b* and the second domains 13*c* are dispersed in the external additive resin 13*a*. The first domains 13*b* and the second domains 13*c* each have a particle shape and are each substantially made from a temperature responsive polymer.

The term "temperature responsive" refers to such a property of a substance soluble in water at low temperatures that the substance sharply becomes less hydrophilic (that is, becomes highly hydrophobic) to be insoluble in water by being heated to a temperature exceeding a temperature called a lower critical solution temperature (LCST) of the substance and that sharply becomes less hydrophobic (that is, becomes highly hydrophilic) to be soluble in water by being cooled again to a temperature below the temperature (LCST). A temperature responsive polymer is a substance that reversibly changes in sensitive response to an external temperature stimulus. A typical temperature responsive polymer has a hydrogen bondable portion in water and dissolves in water at low temperatures through water molecules firmly adhering around stretching macromolecule chains thereof. However, the macromolecule chains of the temperature responsive polymer contracts (coheres) when heated. Therefore, the temperature responsive polymer phase-separates from water at high temperatures to become insoluble in water and precipitate. Whether or not the temperature responsive polymer is dissolved in water can be determined according to transparency of the water. Specifically, when the temperature of water containing a temperature responsive polymer exceeds the LCST of the temperature responsive polymer, the temperature responsive polymer becomes insoluble with a result that the water is whitened. By contrast, when the temperature of the water falls below the LCST thereof, the temperature responsive polymer dissolves with a result that the water becomes transparent.

The temperature responsive polymer constituting the second domains 13*c* has a LCST higher than that of the temperature responsive polymer constituting the first domains 13*b*. The present inventor found that as a result of the resin particles 13 (the external additive of the toner particles) containing the two types of domains (the first domains 13*b* and the second domains 13*c*), the charge amount of a toner can be kept at an appropriate level in image formation in wide temperature range environments (specifically, all of a low-temperature and low-humidity environment, a normal-temperature and normal-humidity environment, and a high-temperature and high-humidity environment).

Figure 3:
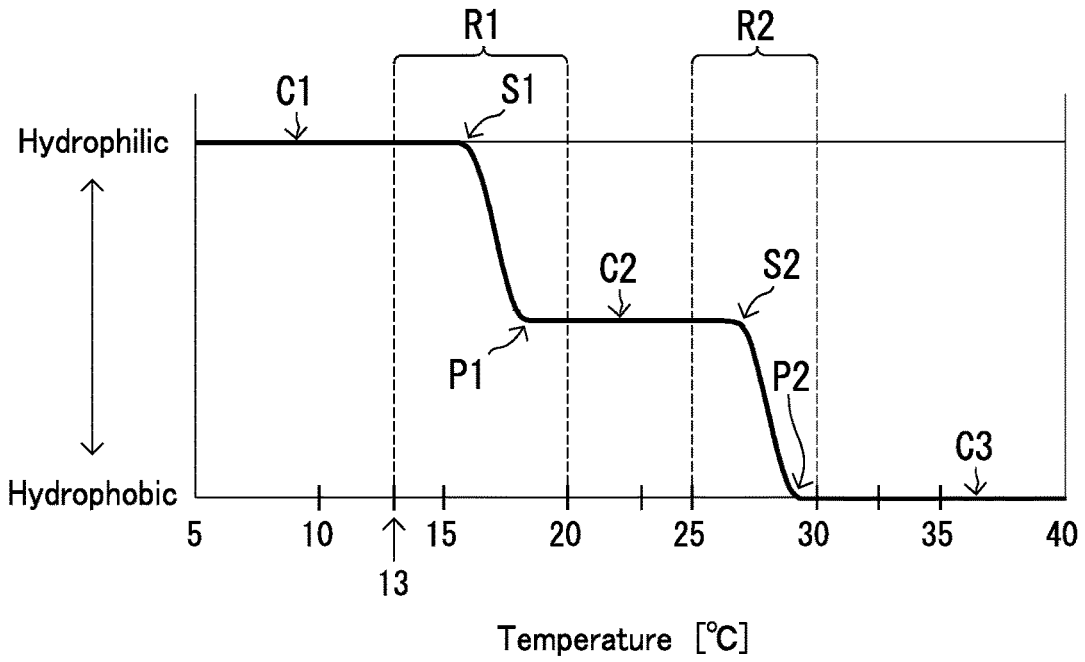
FIG. 3 is a graph representation showing a temperature characteristic of degree of hydrophobicity (or degree of hydrophilicity) of a toner external additive (resin particles) according to the embodiment of the present disclosure.

For example, the toner can be charged by friction with a surface of a development sleeve or a blade in a development device in image formation using a one-component developer (e.g., a magnetic toner). Also, the toner can be charged by friction with a carrier in image formation using a two-component developer (e.g., a mixture of the toner and a magnetic carrier). However, in a situation in which typical resin particles are used as a toner external additive, the toner tends to be excessively charged in the low-temperature and low-humidity environment and tends to be insufficiently charged in the high-temperature and high-humidity environment. It is thought that surfaces of the toner particles are dry in the low-temperature and low-humidity environment with a result that the toner tends to be excessively charged. It is thought that the surfaces of the toner particles are wet in the high-temperature and high-humidity environment with a result that the toner tends to be insufficiently charged. In view of the foregoing, the resin particles (external additive) of the toner having the basic features each contain the low TR domains and the high TR domains. Use of the toner as above enables the charge amount of the toner to be kept at an appropriate level in image formation in wide temperature range environments (specifically, all of the low-temperature and low-humidity environment, the normal-temperature and normal-humidity environment, and the high-temperature and high-humidity environment). FIG. 3 shows a temperature characteristic of degree of hydrophobicity (or degree of hydrophilicity) of an example of the resin particles (external additive) of the toner having the basic features.

As shown in FIG. 3, degree of hydrophobicity (or degree of hydrophilicity) of the resin particles containing the low TR domains and the high TR domains changes depending on temperature. In the example shown in FIG. 3, the LCST of the low TR domains is approximately 17° C. and that of the high TR domains is approximately 28° C. The graph representation in FIG. 3 shows a first stable portion C1, a first shoulder S1, a first saturation point P1, a second stable portion C2, a second shoulder S2, a second saturation point P2, and a third stable portion C3. In the example in FIG. 3, the first shoulder S1 and the first saturation point P1 are included in a temperature range R1 between 13° C. and 20° C. Also, the second shoulder S2 and the second saturation point P2 are included in a temperature range R2 between 25° C. and 30° C.

The first stable portion C1 extends over a temperature range sufficiently lower than the LCST of the low TR domains. The resin particles are stably and highly hydrophilic (i.e., have substantially constant degree of hydrophilicity) in such a low temperature range. Once the temperature of the resin particles is increased to the temperature of the first shoulder S1, the resin particles start sharply decreasing in degree of hydrophilicity. The degree of hydrophilicity of the resin particles decreases at such a large change rate for a certain period of time and then the change rate gradually decreases. When the temperature of the resin particles is further increased to the temperature of the first saturation point P1, the degree of hydrophobicity (or degree of hydrophilicity) of the resin particles stops changing and becomes stable again. Note that the LCST of the low TR domains is between the temperature of the first shoulder S1 and that of the first saturation point P1.

The second stable portion C2 extends over a temperature range between the temperature of the first saturation point P1 and that of the second shoulder S2. In the above temperature range, the degree of hydrophobicity (or the degree of hydrophilicity) of the resin particles is stable and substantially constant. However, once the temperature of the resin particles is increased to the temperature of the second shoulder S2, the resin particles start sharply increasing in degree of hydrophobicity. The degree of hydrophobicity of the resin particles increases at such a large change rate for a certain period of time and then the change rate gradually decreases. When the temperature of the resin particles is further increased to the temperature of the second saturation point P2, the degree of hydrophobicity of the resin particles stops changing and becomes stable again. Note that the LCST of the high TR domains is between the temperature of the second shoulder S2 and that of the second saturation point P2.

The third stable portion C3 extends over a temperature range sufficiently higher than the LCST of the high TR domains. The resin particles are stably and highly hydrophobic (i.e., have substantially constant degree of hydrophobicity) in the high temperature range.

The low TR domains and the high TR domains are water-soluble in temperature ranges lower than the respective LCSTs and water-insoluble in temperature ranges higher than the respective LCSTs. Therefore, the low TR domains and the high TR domains are water-soluble in the first stable portion C1. The low TR domains are water-insoluble while the high TR domains are water-soluble in the second stable portion C2. The low TR domains and the high TR domains are water-insoluble in the third stable portion C3. The resin particles are highly hydrophilic in the first stable portion C1 (a low-temperature range). The resin particles are amphipathic in the second stable portion C2 (a normal-temperature range). The resin particles are highly hydrophobic in the third stable portion C3 (a high-temperature range). The degree of hydrophobicity (or the degree of hydrophilicity) of the resin particles changes in three stages (the first stable portion C1, the second stable portion C2, and the third stable portion C3) depending on temperature. Through the above change, an appropriate amount of moisture is attached to the resin particles in the low-temperature and low-humidity environment similarly to in the normal-temperature and normal-humidity environment, with a result that a situation in which the toner is excessively charged can be inhibited. In the high-temperature and high-humidity environment, moisture is hardly attached to the resin particles and therefore a decrease in charge amount of the toner due to moisture attachment can be prevented. As a result, sufficient charge amount of the toner can be easily ensured even in the high-temperature and high-humidity environment.

In order that the charge amount of the toner is kept at an appropriate level and high-quality images are continuously formed in any of an environment at a temperature of 10.0° C. and a relative humidity of 10.0%, an environment at a temperature of 23.0° C. and a relative humidity of 50.0%, and an environment at a temperature of 32.5° C. and a relative humidity of 80.0%, it is particularly preferable that the LCST of the low TR domains (first temperature responsive polymer domains) is at least 13° C. and no greater than 20° C. and that of the high TR domains (second temperature responsive polymer domains) is at least 25° C. and no greater than 30° C. in the "basic features of the toner" (see later-described external additives EA-1 to EA-6).

It is difficult to obtain a temperature responsive polymer having a desired LCST through polymerization of only one type of temperature responsive monomer. In particular, it is difficult to obtain a temperature responsive polymer having a LCST of at least 13° C. and no greater than 20° C. through polymerization of only one type of temperature responsive monomer. In view of the foregoing, the first temperature responsive polymer having a LCST of at least 13° C. and no greater than 20° C. that constitutes the low TR domains is preferably a polymer of monomers (polymer raw materials) including at least two types of temperature responsive monomers. A polymer of only one type of temperature responsive monomer may be also referred to below as a "homopolymerized TR polymer". Also, a polymer of monomers including at least two types of temperature responsive monomers may be also referred to below as a "copolymerized TR polymer".

Preferable examples of a copolymerized TR polymer constituting the low TR domains include a polymer of monomers (polymer raw materials) including acrylamide having an acetyl group at a position of a nitrogen atom (e.g., N-acetyl acrylamide) and methacrylamide having an acetyl group at a position of a nitrogen atom (e.g., N-acetyl methacrylamide). The LCST of the copolymerized TR polymer tends to increase as an amount of acrylamide having an acetyl group at a position of a nitrogen atom is increased relative to an amount of methacrylamide having an acetyl group at a position of a nitrogen atom.

Preferably, the second temperature responsive polymer constituting the high TR domains is also a copolymerized TR polymer in order to easily and surely obtain the high TR domains having a LCST of at least 25° C. and no greater than 30° C.

Preferable examples of a copolymerized TR polymer constituting the high TR domains include a polymer of monomers (polymer raw materials) including (meth)acrylamide having a straight chain alkyl group at a position of a nitrogen atom (e.g., N-normal propyl acrylamide) and (meth)acrylamide having a branched alkyl group at a position of a nitrogen atom (e.g., N-isopropyl acrylamide). The straight chain alkyl group and the branched alkyl group each preferably have a carbon number of at least 1 and no greater than 8, and particularly preferably have three or four carbons.

However, the second temperature responsive polymer constituting the high TR domains may be a homopolymerized TR polymer. Preferable examples of a homopolymerized TR polymer constituting the high TR domains include a polymer of monomers (polymer raw materials) including (meth)acrylamide having a cyclic ether group at a position of a nitrogen atom (e.g., N-tetrahydrofurfuryl acrylamide). Even in a configuration in which the monomers (polymer raw materials) of the second temperature responsive polymer include only one type of temperature responsive monomer, the high TR domains having a LCST of at least 25° C. and no greater than 30° C. can be obtained (see a later-described temperature responsive polymer TR-9).

For example, polymerization of any of the following temperature responsive monomers can obtain a temperature responsive polymer. Preferable examples of temperature responsive polymers include N-isopropylacrylamide, N-normal propylacrylamide, N-normal propylmethacrylamide, N-(ethoxyethyl)acrylamide, N-tetrahydrofurfuryl acrylamide, N-tetrahydrofurfuryl methacrylamide, N-ethyl acrylamide, N,N-diethyl acrylamide, N-isopropylmethacrylamide, N-cyclopropylacrylamide, N-cyclopropylmethacrylamide, N-acryloylpyrrolidine, N-acryloylpiperidine, and methyl vinyl ether. A polymer of only N-isopropylacrylamide has a LCST of 32° C. A polymer of only N-normal propylacrylamide has a LCST of 21° C. A polymer of only N-normal propylmethacrylamide has a LCST of 32° C. A polymer of only N-(ethoxyethyl)acrylamide has a LCST of 35° C. A polymer of only N-tetrahydrofurfuryl acrylamide has a LCST of 29° C. A polymer of only N-tetrahydrofurfuryl methacrylamide has a LCST of 35° C. A polymer of only N,N-diethyl acrylamide has a LCST of 32° C.

It is particularly preferable in the "basic features of the toner" that: the resin particles (external additive) contain a thermosetting resin (e.g., an epoxy resin) as an external additive resin; the low TR domains and the high TR domains are dispersed in the thermosetting resin (external additive resin); and the resin particles (external additive) have a number average primary particle diameter of at least 10 nm and no greater than 150 nm. Resin particles such as above can improve fluidity of the toner and function as spacers among the toner particles. As a result of the resin particles having a not excessively large particle diameter, detachment of the resin particles from the toner particles can be inhibited. In order to inhibit detachment of the resin particles from the toner particles, the resin particles particularly preferably have a number average primary particle diameter of no greater than 140 nm. It is also particularly preferable that the resin particles have a number average primary particle diameter of at least 50 nm in order to allow the resin particles to function as spacers among the toner particles. When the resin particles function as spacers, aggregation of the toner particle can be inhibited. It is thought that when aggregation of the toner particles is inhibited, heat-resistant preservability of the toner can be improved. Also, as a result of the resin particles having a sufficiently large particle diameter, the resin particles are hardly buried in the toner mother particles upon stress application to the toner.

In order that the charge amount of the toner is kept at an appropriate level and high-quality images are formed continuously in wide temperature range environments, it is particularly preferable that: a difference in LCST between the low TR domains and the high TR domains of the resin particles (external additive) containing the thermosetting resin is at least 5° C. and no greater than 20° C.; the amount of the low TR domains and the amount of the high TR domains each are at least 10% by mass and no greater than 20% by mass relative to a total mass of the thermosetting resin, the low TR domains, and the high TR domains; and a total mass of the low TR domains and the high TR domains is at least 20% by mass and no greater than 40% by mass relative to the total mass of the thermosetting resin, the low TR domains, and the high TR domains (see later-described external additives EA-1 to EA-6).

The toner mother particles contain a binder resin. The toner mother particles may optionally contain an internal additive (for example, at least one of a releasing agent, a colorant, a charge control agent, and a magnetic powder) as necessary. The toner mother particles may each be a toner mother particle including no shell layer (also referred to below as a non-capsule toner mother particle) or a toner mother particle including a shell layer (also referred to below as a capsule toner mother particle). The capsule toner mother particle includes a toner core and a shell layer covering a surface of the toner core. The shell layer is substantially made from a resin. For example, when the toner cores that melt at a low temperature are covered with shell layers excellent in heat resistance, the toner can have both heat-resistant preservability and low-temperature fixability. An additive may be dispersed in the resin forming the shell layers. The shell layer may entirely or partially cover the surface of the toner core. The capsule toner mother particles may be produced using later-described non-capsule toner mother particles as the toner cores.

In order to produce a toner suitable for image formation, the toner preferably includes the resin particles defined in the basic features (the external additive according to the present embodiment) at a ratio of at least 0.5% by mass and no greater than 1.5% by mass relative to a total mass of the toner mother particles, and particularly preferably at least 0.7% by mass and no greater than 1.3% by mass.

The toner mother particles preferably have a volume median diameter ($D_{50}$) of at least 4 μm and no greater than 9 μm in order to produce a toner suitable for image formation.

A pulverization method and an aggregation method are preferable examples of a production method of non-capsule toner mother particles. These methods can easily achieve favorable dispersion of an internal additive in the binder resin. A toner produced by the pulverization method belongs to a pulverized toner, while a toner produced by the aggregation method belongs to a polymerized toner (also called a chemical toner).

In an example of the pulverization method, a binder resin, a colorant, a charge control agent, and a releasing agent are mixed together first. Subsequently, a resulting mixture is melt-kneaded using a melt-kneader (e.g., a single or twin screw extruder). The resulting melt-kneaded substance is then pulverized and classified. Through the above, toner mother particles are produced. The toner mother particles can be produced by the pulverization method more easily than by the aggregation method in many cases.

In an example of the aggregation method, fine particles of a binder resin, fine particles of a releasing agent, and fine particles of a colorant in an aqueous medium containing the respective fine particles are caused to aggregate to have respective desired particle diameters. Through the above aggregation, aggregated particles containing the binder resin, the releasing agent, and the colorant are formed. Next, the resulting aggregated particles are heated to cause coalescence of components contained in the aggregated particles. Through the above, toner mother particles having a desired particle diameter are produced.

In-situ polymerization, in-liquid curing film coating, and coacervation are examples of shell layer formation processes. In order to inhibit dissolution or elution of toner core components (particularly, the binder resin and the releasing agent) in shell layer formation, the shell layers are preferably formed on surfaces of the toner cores in an aqueous medium containing respective materials of the toner cores and the shell layers.

The following describes the non-capsule toner mother particles and the external additive in the stated order. However, unnecessary components may be omitted according to use of the toner.

[Toner Mother Particles]

(Binder Resin)

Typically, the binder resin is a main component (for example, at least 85% by mass) of the toner mother particles. Properties of the binder resin are therefore expected to have great influence on an overall property of the toner mother particles. When plural types of resins are used in combination as the binder resin, properties of the binder resin (specific examples include hydroxyl value, acid value, Tg, and Tm) can be adjusted. When the binder resin has an ester group, a hydroxyl group, an ether group, an acid group, or a methyl group, the toner mother particles are highly likely to be anionic. When the binder resin has an amino group, the toner mother particles are highly likely to be cationic.

Preferable examples of the binder resin include thermoplastic resins such as styrene-based resins, acrylic acid-based resins (specific examples include polymers of acrylic acid ester and polymers of methacrylic acid ester), olefin-based resins (specific examples include polyethylene resins and polypropylene resins), vinyl chloride resins, polyvinyl alcohols, vinyl ether resins, N-vinyl resins, polyester resins, polyamide resins, and urethane resins. Copolymers of the above listed resins, that is, copolymers obtained by introducing a repeating unit into the above-listed resins (specific examples include styrene-acrylic acid-based resins and styrene-butadiene-based resins) can be favorably used as the binder resin.

The toner mother particles preferably contain either or both a polyester resin and a styrene-acrylic acid-based resin as the binder resin in order that the toner has both heat-resistant preservability and low-temperature fixability.

The polyester resin can be obtained through polycondensation of at least one polyhydric alcohol and at least one polybasic carboxylic acid. The polyester resin contains an alcohol component and an acid component. The following dihydric alcohols (specific examples include diols and bisphenols) and tri- or higher-hydric alcohols can for example be favorably used each as an alcohol for synthesis of the polyester resin. The following dibasic carboxylic acids and tri- or higher-basic carboxylic acids can for example be favorably used each as a carboxylic acid for synthesis of the polyester resin.

Preferable examples of the diols include ethylene glycol, diethylene glycol, triethylene glycol, 1,2-propanediol, 1,3-propanediol, 1,4-butanediol, neopentyl glycol, 2-butene-1,4-diol, 1,5-pentanediol, 1,6-hexanediol, 1,4-cyclohexanedimethanol, dipropylene glycol, polyethylene glycol, polypropylene glycol, and polytetramethylene glycol.

Preferable examples of the bisphenols include bisphenol A, hydrogenated bisphenol A, bisphenol A ethylene oxide adduct, and bisphenol A propylene oxide adduct.

Preferable examples of the tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of the dibasic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, and succinic acid.

Preferable examples of the tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

The styrene-acrylic acid-based resin is a copolymer of at least one styrene-based monomer and at least one acrylic acid-based monomer. The following styrene-based monomers and acrylic acid-based monomers for example can be favorably used for synthesis of the styrene-acrylic acid-based resin.

Examples of preferable styrene-based monomers include styrene, alkylstyrenes (specific examples include α-methylstyrene, p-ethylstyrene, and 4-tert-butylstyrene), p-hydroxy styrene, m-hydroxy styrene, α-chlorostyrene, o-chlorostyrene, m-chlorostyrene, and p-chlorostyrene.

Examples of preferable acrylic acid-based monomers include (meth)acrylic acid, (meth)acrylonitrile, alkyl (meth) acrylates, and hydroxyalkyl (meth)acrylates. Preferable examples of the alkyl (meth)acrylates include methyl (meth) acrylate, ethyl (meth)acrylate, n-propyl (meth)acrylate, isopropyl (meth)acrylate, n-butyl (meth)acrylate, iso-butyl (meth)acrylate, and 2-ethylhexyl (meth)acrylate. Preferable examples of the hydroxyalkyl (meth)acrylates include 2-hydroxyethyl (meth)acrylate, 3-hydroxypropyl (meth)acrylate, 2-hydroxypropyl (meth)acrylate, and 4-hydroxybutyl (meth) acrylate.

The toner mother particles particularly preferably contain as the binder resin a first polyester resin having a mass average molecular weight (Mw) of at least 150,000 and no greater than 500,000 and a glass transition point (Tg) of at least 55° C. and no greater than 70° C. and a second polyester resin having a mass average molecular weight (Mw) of at least 60,000 and no greater than 95,000 and a glass transition point (Tg) of at least 55° C. and no greater than 70° C. in order that the toner has both heat-resistant preservability and low-temperature fixability.

(Colorant)

The toner mother particles may contain a colorant. The colorant can be a known pigment or dye that matches the color of the toner. The amount of the colorant is preferably at least 1 part by mass and no greater than 20 parts by mass relative to 100 parts by mass of the binder resin in order to obtain a toner suitable for image formation.

The toner mother particles may contain a black colorant. Carbon black can be used as a black colorant, for example. The black colorant may be a colorant whose color is adjusted to black using a yellow colorant, a magenta colorant, and a cyan colorant. A later-described magnetic powder may be used as a black colorant. That is, the toner mother particles may not contain a colorant other than the magnetic powder.

The toner mother particles may contain a non-black colorant such as a yellow colorant, a magenta colorant, or a cyan colorant. Specific examples of the yellow colorant include naphthol yellow, monoazo yellow, diazo yellow, disazo yellow, and anthraquinone compounds. Specific examples of the magenta colorant include quinacridone compounds, naphthol compounds, carmine 6B, and monoazo red. Specific examples of the cyan colorant include Phthalocyanine Blue and anthraquinone compounds.

(Releasing Agent)

The toner mother particles may contain a releasing agent. The releasing agent is for example used in order to improve fixability of the toner or resistance of the toner to being offset. The releasing agent is preferably contained in an amount of at least 1 part by mass and no greater than 30 parts by mass relative to 100 parts by mass of the binder resin in order to improve fixability or offset resistance of the toner.

Examples of releasing agents that can be preferably used include: aliphatic hydrocarbon waxes such as low molecular weight polyethylenes, low molecular weight polypropylenes, polyolefin copolymers, polyolefin waxes, microcrystalline waxes, paraffin waxes, and Fischer-Tropsch waxes; oxides of aliphatic hydrocarbon waxes such as oxidized polyethylene waxes and block copolymers of oxidized polyethylene waxes; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes containing a fatty acid ester as a major component such as montanic acid ester wax and castor wax; and waxes containing partially or fully deoxidized fatty acid esters such as deoxidized carnauba wax. One of the releasing agents listed above may be used alone, or a plurality of the releasing agents listed above may be used in combination.

(Charge Control Agent)

The toner mother particles may contain a charge control agent. The charge control agent is for example used in order to improve charge stability or a charge rise characteristic of the toner. The charge rise characteristic of the toner is an indicator as to whether the toner can be charged to a specific charge level in a short period of time.

As a result of a negatively chargeable charge control agent (specific examples include organic metal complexes and chelate compounds) being contained in the toner mother particles, anionic strength of the toner mother particles can be increased. By contrast, as a result of a positively chargeable charge control agent (specific examples include pyridine, nigrosine, and quaternary ammonium salt) being contained in the toner mother particles, cationic strength of the toner mother particles can be increased. For example, two or more types of positively chargeable charge control agents may be contained in the toner mother particles in order to increase positive chargeability of the toner. However, it is not essential for the toner mother particles to contain a charge control agent if sufficient chargeability of the toner can be ensured without the charge control agent.

(Magnetic Powder)

The toner mother particles may contain a magnetic powder. Examples of materials of the magnetic powder that can be preferably used include ferromagnetic metals (specific examples include iron, cobalt, nickel, and alloy thereof), oxides of ferromagnetic metals (specific examples include ferrite, magnetite, and chromium dioxide), and materials subjected to ferromagnetization (specific examples include carbon materials to which ferromagnetism is imparted through thermal treatment). One type of the magnetic powders listed above may be used alone, or plural types of magnetic powders listed above may be used in combination.

[External Additive]

An external additive (specifically, a powder including a plurality of external additive particles) is attached to the surfaces of the toner mother particles. Different from the internal additive, the external additive is not present inside the toner mother particles and is selectively present on the surfaces of the toner mother particles (surface portions of the toner particles). For example, the external additive particles can be attached to each of the surfaces of the toner mother particles by stirring the toner mother particles (a powder) and the external additive (a powder) together. The toner mother particle and the external additive particles do not chemically react with one another and are bonded to one another physically rather than chemically. Bonding strength between the toner mother particle and the external additive particles can be adjusted for example according to the diameter, shape, and surface state of the external additive particles and conditions for stirring (specific examples include a time period and a rotational speed for stirring).

The resin particles defined in the basic features (the external additive according to the present embodiment) each contain the low TR domains and the high TR domains in addition to the external additive resin. A thermosetting resin is preferable as the external additive resin. Preferable examples of the external additive resin include thermosetting resins such as epoxy resins, melamine resins, urea resins, phenolic resins, urethane resins, and aniline resins. An epoxy resin is particularly preferable among the above listed resins.

In order to further improve either or both fluidity and chargeability of the toner, it is preferable to attach inorganic particles to the surfaces of the toner mother particles in addition to the resin particles defined in the basic features (the external additive according to the present embodiment). Preferable examples of the inorganic particles include silica particles and particles of metal oxides (specific examples include alumina, titanium oxide, magnesium oxide, zinc oxide, strontium titanate, and barium titanate). Silica particles or particles of titanium oxide are particularly preferable among the particles listed above. In order to obtain a toner excellent in both fluidity and chargeability, resin particles (specifically, the resin particles defined in the basic features) having a number average primary particle diameter of at least 50 nm and no greater than 140 nm and positively chargeable silica particles (a powder) having a number average primary particle diameter of at least 5 nm and no greater than 30 nm are particularly preferably attached to the surfaces of the toner mother particles. It is preferable that the external additive particles are weakly bonded to the surfaces of the toner mother particles in order to improve fluidity of the toner through use of the external additive particles. The resin particles (specifically, the resin particles defined in the basic features) and the positively chargeable silica particles are preferably attached to the surfaces of the toner mother particles mainly by Van der Waals force or electrostatic force.

The positively chargeable silica particles are obtained through surface treatment on a silica base (untreated silica particles). When the surface of the silica base is treated with a surface treatment agent, multiple hydroxyl groups (—OH) present on the surface of the silica base are partially or completely substituted by a functional group originated from the surface treatment agent. As a result, silica particles having on the surfaces thereof the functional group originated from the surface treatment agent (specifically, a functional group having both or either higher hydrophobicity and positive chargeability than the hydroxyl groups) can be obtained. For example, when the surface of the silica base is treated with a silane coupling agent having an amino group, dehydration condensation reaction ("A (silica base)-OH"+"B (coupling agent)-OH"→"A-O—B"+$H_2O$) occurs between a hydroxyl group of the silane coupling agent (for example, a hydroxyl group generated through hydrolysis of an alkoxy group in the silane coupling agent by moisture) and a hydroxyl group present on the surface of the silica base. The silica base and the silane coupling agent having an amino group are chemically bonded together through a reaction such as above to provide the amino group to the surfaces of the silica particles, thereby obtaining positively chargeable silica particles. Specifically, the hydroxyl group present on the surface of the silica base is substituted by a functional group having an amino group at a terminal thereof (specific examples include —O—Si—$(CH_2)_3$—$NH_2$). The silica particles provided with the amino group tend to have higher positive chargeability than the silica base. When a silane coupling agent having an alkyl group is used, hydrophobic silica particles are obtained. Specifically, the hydroxyl group present on the surface of the silica base can be substituted by a functional group having an alkyl group at a terminal thereof (specific examples include —O—Si—$CH_3$) through the above dehydration condensation reaction. As described above, the silica particles provided with a hydrophobic group (for example, an alkyl group having a carbon number of at least 1 and no greater than 3) instead of a hydrophilic group (hydroxyl group) tend to be more hydrophobic than the silica base.

EXAMPLES

The following describes examples of the present disclosure. Table 1 shows external additives EA-1 to EA-9 and EB-1 to EB-3 according to examples and comparative examples. Table 2 shows temperature responsive polymers used for the respective external additives.

TABLE 1

| | Resin | First temperature responsive polymer | | | Second temperature responsive polymer | | | Particle |
|---|---|---|---|---|---|---|---|---|
| External additive | Amount [wt %] | Type | LCST [° C.] | Amount [wt %] | Type | LCST [° C.] | Amount [wt %] | diameter [nm] |
| EA-1 | 70 | TR-2 | 14 | 15.0 | TR-8 | 26 | 15.0 | 100 |
| EA-2 | 70 | TR-3 | 19 | 15.0 | TR-9 | 29 | 15.0 | 100 |
| EA-3 | 80 | TR-2 | 14 | 10.0 | TR-9 | 29 | 10.0 | 100 |
| EA-4 | 60 | TR-2 | 14 | 20.0 | TR-9 | 29 | 20.0 | 100 |
| EA-5 | 70 | TR-4 | 13 | 15.0 | TR-5 | 30 | 15.0 | 100 |
| EA-6 | 70 | TR-6 | 20 | 15.0 | TR-7 | 25 | 15.0 | 100 |
| EA-7 | 70 | TR-1 | 12 | 10.0 | TR-8 | 26 | 20.0 | 100 |
| EA-8 | 90 | TR-2 | 14 | 5.0 | TR-9 | 29 | 5.0 | 100 |
| EA-9 | 70 | TR-2 | 14 | 15.0 | TR-9 | 29 | 15.0 | 140 |

TABLE 1-continued

| External additive | Resin Amount [wt %] | First temperature responsive polymer Type | LCST [° C.] | Amount [wt %] | Second temperature responsive polymer Type | LCST [° C.] | Amount [wt %] | Particle diameter [nm] |
|---|---|---|---|---|---|---|---|---|
| EB-1 | 70 | TR-3 | 19 | 30.0 | None | — | — | 100 |
| EB-2 | 70 | TR-8 | 26 | 30.0 | None | — | — | 100 |
| EB-3 | 100 | None | — | — | None | — | — | 100 |

In Table 1, columns titled "Amount" for columns titled "Resin", "First temperature responsive polymer", and "Second temperature responsive polymer" each list ratios (unit: % by mass) relative to respective total masses of a resin (external additive resin), a corresponding one of first temperature responsive polymers, and a corresponding one of second temperature responsive polymers.

"Particle diameter (unit: nm)" in Table 1 refers to a number average primary particle diameter (specifically, a number average value of equivalent circle diameters of primary particles) of resin particles (external additive). The number average primary particle diameter was measured using a field emission scanning electron microscope (FE-SEM).

TABLE 2

| Temperature responsive polymer | First monomer Type | Amount [g] | Second monomer Type | Amount [g] | LCST [° C.] |
|---|---|---|---|---|---|
| TR-1 | acetyl AA | 6.8 | acetyl MA | 51.7 | 12 |
| TR-2 | acetyl AA | 10.9 | acetyl MA | 47.5 | 14 |
| TR-3 | acetyl AA | 15.5 | acetyl MA | 42.0 | 19 |
| TR-4 | acetyl AA | 9.1 | acetyl MA | 49.5 | 13 |
| TR-5 | acetyl AA | 43.6 | acetyl MA | 11.9 | 30 |
| TR-6 | acetyl AA | 18.2 | acetyl MA | 39.6 | 20 |
| TR-7 | acetyl AA | 27.3 | acetyl MA | 29.7 | 25 |
| TR-8 | n-propyl AA | 45.0 | iso-propyl AA | 15.0 | 26 |
| TR-9 | tetrahydrofurfuryl AA | 60.0 | None | — | 29 |

With respect to "First monomer" and "Second monomer" in Table 2, "acetyl AA", "acetyl MA", "n-propyl AA", "iso-propyl AA", and "tetrahydrofurfuryl AA" refer to respective compounds described below.

Acetyl AA was N-acetyl acrylamide.

Acetyl MA was N-acetyl methacrylamide.

n-propyl AA was N-normal propyl acrylamide.

iso-propyl AA was N-isopropyl acrylamide.

Tetrahydrofurfuryl AA was N-tetrahydrofurfuryl acrylamide.

The following describes a production method, evaluation methods, and evaluation results for toners each containing a corresponding one of the external additives EA-1 to EA-9 and EB-1 to EB-3 in the stated order. In evaluations in which errors may occur, an evaluation value was calculated by calculating the arithmetic mean of an appropriate number of measured values in order to ensure that any errors were sufficiently small.

[Preparation of Materials]

(Preparation of External Additive Resin)

A flask (first flask) equipped with a thermometer, a cooling pipe, a fractionating column, a nitrogen inlet tube, a stirrer, and a heater was charged with 20 mL of methanol at a concentration of 99% by mass, 18.6 g (0.1 mol) of bisphenol, and 36.2 g (0.2 mol) of 6-bromo-1-hexanol. Subsequently, the flask contents were stirred at a temperature of 75° C. in a nitrogen atmosphere to dissolve solid materials in a solvent. Then, an ethanol solution of potassium hydroxide (specifically, a liquid in which 13.0 g (0.2 mol) of potassium hydroxide having a KOH content of 86% by mass was dissolved in 20 mL of ethanol at a concentration of 99% by mass) was dripped into the flask over 30 minutes at a constant rate while the flask contents were stirred. The temperature of the flask contents after the dripping was increased around a boiling point of the solvent while the flask contents were stirred for reflux of the flask contents for four hours. Thereafter, the flask contents were cooled to room temperature (approximately 25° C.).

Next, the flask contents were neutralized using sulfuric acid at a concentration of 30% by mass. The neutralized flask contents were filtered to collect a solid (reaction product) from the flask contents. The collected solid was washed with water and dried, thereby obtaining white crystals.

The white crystals obtained as above (a whole amount of the obtained white crystals), 46.2 g of epichlorohydrin, and 23.1 g of dimethyl sulfoxide were added to a flask (second flask) equipped with a thermometer, a cooling pipe, a fractionating column, a nitrogen inlet tube, a stirrer, and a heater. The internal pressure of the flask was then reduced to 6 kPa. Subsequently, 23 mL of an aqueous solution of potassium hydroxide at a concentration of 48% by mass was dripped into the flask at a constant rate over 60 minutes while reflux of the flask contents was performed under conditions of a pressure of 6 kPa and a temperature of 50° C. During the dripping, by-product water generated through reaction was evaporated while the flask contents were stirred. The temperature of the flask contents after the dripping was increased to 70° C. while the flask contents were stirred for reflux of the flask contents for additional one hour under conditions of a pressure of 6 kPa and a temperature of 70° C.

Subsequently, 40 mL of methyl isobutyl ketone and 45 mL of ion exchanged water were added to the flask (the second flask) to dilute the aqueous solution of potassium hydroxide in the flask. The flask contents were then washed with 100 mL of ion exchanged water to remove dimethyl sulfoxide. Specifically, when ion exchanged water is added to the flask contents, the flask contents separate into a water layer and an oil layer. Dimethyl sulfoxide, which is water soluble, is present in the water layer. Dimethyl sulfoxide was removed from the flask contents by removing the water layer through separation filtration. Only the oil layer was left in the flask. The temperature of the flask contents was then increased to 150° C., and epichlorohydrin (specifically, epichlorohydrin contained in the oil layer) in the flask was removed by reduced-pressure distillation. Through the above, 47.0 g of a thermosetting epoxy resin was left in the flask. The yielded epoxy resin (external additive resin) was used for production of later-described external additives.

(Preparation of Temperature Responsive Polymers TR-1 to TR-9)

With respect to each of temperature responsive polymers TR-1 to TR-9, 500 mL of dimethyl sulfoxide, a corresponding one of the first monomers in a corresponding amount shown in Table 2, a corresponding one of the second monomers in a corresponding amount shown in Table 2, and 250 mg of azobisisobutyronitrile (AIBN) were added to a flask equipped with a thermometer, a nitrogen inlet tube, a stirrer, and a heater. Note that only the first monomer (60 g of N-tetrahydrofurfuryl acrylamide) was added and no second monomer was added in synthesis of the temperature responsive polymer TR-9.

For synthesis of for example the temperature responsive polymer TR-1, 6.8 g of N-acetyl acrylamide and 51.7 g of N-acetyl methacrylamide were added. For synthesis of the temperature responsive polymer TR-8, 45.0 g of N-normal propyl acrylamide and 15.0 g of N-isopropyl acrylamide were added.

Subsequently, the flask contents were stirred for three hours at a temperature of 75° C. in a nitrogen atmosphere to obtain a reaction liquid.

A beaker was set in a magnetic stirring apparatus, and 2,000 mL of ethanol and a stirrer including a bar-shaped magnet therein were put into the beaker. The reaction liquid obtained as above was dripped little by little into the beaker while the beaker contents were vigorously stirred using the stirrer in the magnetic stirring apparatus. The beaker contents after the dripping were stirred for additional two hours to obtain precipitate in the beaker. Subsequently, the beaker contents were filtered to separate the beaker contents into a solid and a liquid. The solid (i.e., the precipitate) separated from the beaker contents was washed with ethanol and dried at room temperature (approximately 25° C.) in a reduced-pressure atmosphere to obtain 50 g of a temperature responsive polymer (white solid).

Results of LCST measurement for the temperature responsive polymers TR-1 to TR-9 obtained as above were as shown in Table 2. For example, the temperature responsive polymer TR-1 had a LCST of 12° C. The LCST measuring method was as follows.

<LCST Measuring Method>

With respect to each of the polymers (measurement targets: temperature responsive polymers TR-1 to TR-9), 25 mg of the polymer was dissolved in 5 mL of distilled water at a temperature of 10° C. to obtain a transparent polymer solution. A transmittance (specifically, a transmittance in a visible range) of the obtained polymer solution was measured. The measured transmittance herein is referred to below as an "initial transmittance". Each of the temperature responsive polymers TR-1 to TR-9 had an initial transmittance of 100%. While the temperature of the polymer solution was increased from 10° C. at a rate of 0.5° C./minute, a transmittance (specifically, a transmittance in a visible range) of the polymer solution was measured each time the temperature was increased by 0.5° C. A ultraviolet-visible-near-infrared spectrophotometer ("UV-3600" produced by Shimadzu Corporation) was used for the transmittance measurement. When the transmittance of the polymer aqueous solution after the temperature increase reached 90% (that is, 0.9 times) or below relative to the initial transmittance thereof, it was determined that the temperature of water containing the temperature responsive polymer exceeded the LCST of the temperature responsive polymer. In measurement of each of the temperature responsive polymers TR-1 to TR-9, the polymer solution of which had an initial transmittance of 100%, it was determined that the temperature of water containing the temperature responsive polymer exceeded the LCST of the temperature responsive polymer when the transmittance of the polymer solution after the temperature increase reached 90% (=100×0.9) or below. The reason why the transmittance varies is thought that water containing a temperature responsive polymer is whitened through insolubilization of the temperature responsive polymer.

For example, when the temperature of water containing the temperature responsive polymer TR-1 was increased from 11.5° C. to 12.0° C., the water was whitened and had a transmittance of no greater than 90%. Thus, the temperature responsive polymer TR-1 was determined to have a LCST of 12.0° C.

[Production Methods of External Additives EA-1 to EA-9 and EB-1 to EB-3]

With respect to each of the external additives EA-1 to EA-9 and EB-1 to EB-3, the external additive resin (that is, the epoxy resin prepared as described above) in a corresponding amount listed in the column titled "Resin" in Table 1, first and second temperature responsive polymers of respective corresponding types in respective corresponding amounts shown in Table 1, and tetrahydrofuran (THF) were added to a vessel equipped with a thermometer and a stirrer (stirring impeller). The vessel contents were stirred for one hour in a normal-temperature (approximately 25° C.) environment. The polymers (the epoxy resin and the temperature responsive polymers) added to the vessel dissolved in THF, thereby obtaining a polymer solution.

The total mass of the external additive resin (epoxy resin) and the first and second temperature responsive polymers was 10 g. That is, in a situation in which neither the first temperature responsive polymer nor the second temperature responsive polymer was added, 10 g of the external additive resin (epoxy resin) was added. In production of the external additive EB-3, neither the first temperature responsive polymer nor the second temperature responsive polymer was added. In production of each of the external additives EB-1 and EB-2, only the first temperature responsive polymer (EB-1: temperature responsive polymer TR-3, EB-2: temperature responsive polymer TR-8) was added and no second temperature responsive polymer was added.

The amount of THF was set so that resin particles having a corresponding one of the particle diameters shown in Table 1 could be obtained. Specifically, the larger the particle diameter of the resin particles to be produced is, the less the amount of THF was set. For example, in production of the external additive EA-1, 7.0 g of the external additive resin (epoxy resin), 1.5 g of the temperature responsive polymer TR-2, and 1.5 g of the temperature responsive polymer TR-8 were dissolved in 26.2 mL of THF to obtain a polymer solution at a solid concentration of 27% by mass. In production of the external additive EA-9, 7.0 g of the external additive resin (epoxy resin), 1.5 g of the temperature responsive polymer TR-2, and 1.5 g of the temperature responsive polymer TR-9 were dissolved in 17.0 mL of THF to obtain a polymer solution at a solid concentration of 37% by mass.

Subsequently, particle formation by spray granulation (atomization) with the polymer solution obtained as above was performed using a spray dryer ("FOC-25" produced by OKAWARA MFG. CO., LTD.). Specifically, particle formation (spraying and drying of the polymer solution) was performed for five hours using the spray dryer (FOC-25) to obtain a powder including a plurality of resin particles. The obtained powder was sifted to obtain a powder (any one of the external additives EA-1 to EA-9 and EB-1 to EB-3) of resin particles having a corresponding one of the number average primary particle diameters shown in the column titled "Particle diameter" in Table 1. The resin particles of each type contained the epoxy resin (external additive resin). A plurality of temperature responsive polymer domains were dispersed in the epoxy resin in the external additives other than the external additive EB-3.

[Evaluation Methods]

Each of the external additives (external additives EA-1 to EA-9 and EB-1 to EB-3) was evaluated by the following evaluation methods.

(Production of Evaluation Toner: Preparation of Toner Mother Particles)

Using an FM mixer ("FM-10B" produced by Nippon Coke & Engineering Co., Ltd.), toner materials (a first polyester resin, a second polyester resin, a colorant, a releasing agent, and a charge control agent) were mixed together at the following ratio.

First polyester resin: 48 parts by mass.

Second polyester resin: 39 parts by mass.

Colorant: 8 parts by mass.

Releasing agent: 3 parts by mass.

Charge control agent: 2 parts by mass.

The first polyester resin used was a polyester resin having a mass average molecular weight (Mw) of 300,000 and a glass transition point (Tg) of 65° C. The second polyester resin used was a polyester resin having a mass average molecular weight (Mw) of 75,000 and a glass transition point (Tg) of 61° C. The colorant used was a carbon black ("MA100" produced by Mitsubishi Chemical Corporation). The releasing agent used was an ester wax ("NISSAN ELECTOL (registered Japanese trademark) WEP-5" produced by NOF Corporation). The charge control agent used was a nigrosine dye ("BONTRON (registered Japanese trademark) N-71" produced by ORIENT CHEMICAL INDUSTRIES, Co., Ltd.).

After the mixing of the toner materials at the above ratio, the resulting mixture of the toner materials was melt-kneaded using a twin screw extruder ("TEM-265S" produced by Toshiba Machine Co. Ltd.). The resulting kneaded substance was subsequently cooled. The cooled kneaded substance was coarsely pulverized using a pulverizer ("ROTOPLEX Type 16/8" produced by former Toa Machinery Mfg.) set at a set particle diameter of 2 mm. The coarsely pulverized substance was then finely pulverized using a pulverizer ("Turbo Mill Type RS" produced by FREUND-TURBO CORPORATION). The finely pulverized substance was classified using a classifier (air classifier utilizing Coanda effect: "Elbow Jet Type EJ-LABO" produced by Nittetsu Mining Co., Ltd.). Through the above, toner mother particles (a powder) having a volume median diameter ($D_{50}$) of 7 μm were obtained.

(Production of Evaluation Toner: External Additive Addition Process)

Using an FM mixer ("FM-10" produced by Nippon Coke & Engineering Co., Ltd.), 100 parts by mass of the toner mother particles obtained as above, 1.0 part by mass of positively chargeable silica particles ("AEROSIL (registered Japanese trademark) REA200" produced by Nippon Aerosil Co., Ltd., particles: silica particles to which positive chargeability has been imparted through surface treatment, number average primary particle diameter: approximately 13 nm), 1.5 parts by mass of titanium oxide particles ("MT-500B" produced by TAYCA CORPORATION, particles: untreated titanium oxide particles, number average primary particle diameter: approximately 35 nm), and 1.0 part by mass of resin particles (evaluation target: any one of the external additives EA-1 to EA-9 and EB-1 to EB-3) were mixed for five minutes at a rotational speed of 3,500 rpm. Through the mixing, the external additive (the silica particles, the titanium oxide particles, and the resin particles) were attached to the surfaces of the toner mother particles. Next, sifting was performed using a 300-mesh sieve (pore size 48 μm). As a result, toners (evaluation toners) each including multiple toner particles was produced.

<Volume Resistivity of Toner>

An LL environment (temperature: 10.0° C., relative humidity: 10.0%), an NN environment (temperature: 23.0° C., relative humidity: 50.0%), and an HH environment (temperature: 32.5° C., relative humidity: 80.0%) were prepared as measurement environments. The three environments (the LL environment, the NN environment, and the HH environment) were prepared in advance, and measurement was performed in each of the measurement environments in parallel. In the LL environment, the NN environment, and the HH environment, the volume resistivity of each of the evaluation toners obtained as described above was measured by the following method.

First, 5 g of the toner (evaluation toner produced by the above-described method) was left to stand for 24 hours in each of the measurement environments (the LL environment, the NN environment, and the HH environment). Subsequently, the toner was set in a molding machine and subjected to press molding using the molding machine at a pressure of 20 MPa in the measurement environments to form a disk-shaped pellet having a diameter of 40 mm and a thickness of 2 mm. The obtained pellet was left to stand for 24 hours in the measurement environment. The volume resistivity of the pellet was measured in accordance with Japanese Industrial Standard (JIS) K 6911-2006, and a common logarithm value (unit: log Ω·cm) of the measured volume resistivity of the toner was calculated. A super megohmmeter ("SM-8215" produced by HIOKI E. E. CORPORATION) was used as a measuring apparatus. Measurement conditions used were an applied voltage of 500 V and a voltage application period of 60 seconds.

Hereinafter, a common logarithm value of a volume resistivity of a toner measured in the LL environment is referred to as "$R_L$", a common logarithm value of a volume resistivity of the toner measured in the NN environment is referred to as "$R_N$", and a common logarithm value of a volume resistivity of the toner measured in the HH environment is referred to as "$R_H$". "$R_L/R_N$" was calculated by dividing $R_L$ by $R_N$. "$R_N/R_H$" was calculated by dividing $R_N$ by $R_H$.

When $R_L/R_N$ was greater than 0.950 and less than 1.050, a corresponding external additive was evaluated as A "good". When $R_L/R_N$ was no greater than 0.950 or at least 1.050, a corresponding external additive was evaluated as B "poor". When $R_N/R_H$ was greater than 0.970 and less than 1.030, a corresponding external additive was evaluated as A "good". When $R_N/R_H$ was no greater than 0.970 or at least 1.030, a corresponding external additive was evaluated as B "poor".

<Charge Amount of Toner>

An LL environment (temperature: 10.0° C., relative humidity: 10.0%), an NN environment (temperature: 23.0° C., relative humidity: 50.0%), and an HH environment (temperature: 32.5° C., relative humidity: 80.0%) were prepared as measurement environments. The three environments (the LL environment, the NN environment, and the HH environment) were prepared in advance, and measurement was performed in each of the measurement environments in parallel. In the LL environment, the NN environment, and the HH environment, the charge amount of each of the evaluation toners obtained as described above was measured by the following method.

In each of the measurement environments (the LL environment, the NN environment, and the HH environment), 0.5 g of a toner (any one of the evaluation toners obtained through the above described method) and 10 g of an uncoated ferrite carrier ("F-50" produced by Powdertech Co., Ltd., ferrite: Cu—Zn—Fe, number average primary particle diameter: 50 μm) were put into a 20-mL polyethylene bottle and were stirred at a rotational speed of 100 rpm for 30 minutes using a mixer ("TURBULA (registered Japanese trademark) Mixer T2F" produced by Willy A. Bachofen AG (WAB)). A charge amount of the toner in the resulting mixture was then measured.

The charge amount of the toner was measured using a Q/m meter ("MODEL 210HS-1" produced by TREK, INC.). Specifically, the charge amount of the toner (unit: μC/g) was calculated based on an expression "(total amount of electricity (unit: μC) of sucked toner)/(mass of sucked toner (unit: g))".

Hereinafter, a charge amount of a toner measured in the LL environment is referred to as "$Q_L$", a charge amount of the toner measured in the NN environment is referred to as "$Q_N$", and a charge amount of the toner measured in the HH environment is referred to as "$Q_H$". "$Q_L/Q_N$" was calculated by dividing $Q_L$ by $Q_N$. "$Q_N/Q_H$" was calculated by dividing $Q_N$ by $Q_H$.

When $Q_L/Q_N$ was greater than 0.80 and less than 1.60, a corresponding external additive was evaluated as A "good". When $Q_L/Q_N$ was no greater than 0.80 or at least 1.60, a corresponding external additive was evaluated as B "poor". When $Q_N/Q_H$ was greater than 0.80 and less than 2.00, a corresponding external additive was evaluated as A "good". When $Q_N/Q_H$ was no greater than 0.80 or at least 2.00, a corresponding external additive was evaluated as B "poor".

<Image Density>

An evaluation developer (two-component developer) was obtained by mixing 100 parts by mass of a developer carrier (carrier for "FS-05250DN" produced by KYOCERA Document Solutions Inc.) and 10 parts by mass of a toner (any one of the evaluation toners produced by the aforementioned method) for 30 minutes using a ball mill. A printer ("FS-05250DN" produced by KYOCERA Document Solutions Inc.) was used as an evaluation apparatus. The evaluation developer obtained as above was loaded into a development device of the evaluation apparatus, and a toner for replenishment use (the evaluation toner obtained by the above method) was loaded into a toner container of the evaluation apparatus.

The following printing durability test was performed using the evaluation apparatus in each of the LL environment (temperature: 10.0° C., relative humidity: 10.0%), the NN environment (temperature: 23.0° C., relative humidity: 50.0%), and the HH environment (temperature: 32.5° C., relative humidity: 80.0%). In the printing durability test, continuous printing at a printing rate of 5% was performed on 3,000 sheets of paper (A4-size plain paper) using the evaluation apparatus. After the printing durability test, a sample image including three solid portions (portions at a printing rate of 100%) was formed on a recording medium (A4-size evaluation paper) using the evaluation apparatus. An image density (ID) of each of the formed solid portions was measured using a reflectance densitometer ("RD914" produced by X-Rite Inc.), and an arithmetic mean of the three measured values was determined to be an evaluation value (image density).

Hereinafter, an image density measured after the printing durability test in the LL environment is referred to as "$ID_L$", an image density measured after the printing durability test in the NN environment is referred to as "$ID_N$", and an image density measured after the printing durability test in the HH environment is referred to as "$ID_H$". "$ID_L/ID_N$" was calculated by dividing $ID_L$ by $ID_N$. "$ID_N/ID_H$" was calculated by dividing $ID_N$ by $ID_H$.

When $ID_L/ID_N$ was greater than 0.920 and less than 1.080, a corresponding external additive was evaluated as A "good". When $ID_L/ID_N$ was no greater than 0.920 or at least 1.080, a corresponding external additive was evaluated as B "poor". When $ID_N/ID_H$ was greater than 0.940 and less than 1.060, a corresponding external additive was evaluated as A "good". When $ID_N/ID_H$ was no greater than 0.940 or at least 1.060, a corresponding external additive was evaluated as B "poor".

[Evaluation Results]

Evaluation results for the external additives EA-1 to EA-9 and EB-1 to EB-3 are listed in Tables 3 to 5. Tables 3 to 5 show respective measurement results of volume resistivity ($R_L$, $R_N$, $R_H$, $R_L/R_N$, and $R_N/R_H$) for the toners, charge amount ($Q_L$, $Q_N$, $Q_H$, $Q_L/Q_N$, and $Q_N/Q_H$) for the toners, and image density ($ID_L$, $ID_N$, $ID_H$, $ID_L/ID_N$, and $ID_N/ID_H$).

TABLE 3

| | External | Volume resistivity [logΩ · cm] | | | Volume resistivity change | |
|---|---|---|---|---|---|---|
| | additive | $R_L$ | $R_N$ | $R_H$ | $R_L/R_N$ | $R_N/R_H$ |
| Example 1 | EA-1 | 16.3 | 16.0 | 15.7 | 1.019 | 1.019 |
| Example 2 | EA-2 | 16.3 | 16.0 | 15.8 | 1.019 | 1.013 |
| Example 3 | EA-3 | 16.4 | 16.0 | 15.6 | 1.025 | 1.026 |
| Example 4 | EA-4 | 16.2 | 16.0 | 15.8 | 1.013 | 1.013 |
| Example 5 | EA-5 | 16.4 | 16.0 | 15.6 | 1.025 | 1.026 |
| Example 6 | EA-6 | 16.4 | 16.0 | 15.7 | 1.025 | 1.019 |
| Example 7 | EA-7 | 16.7 | 16.0 | 15.7 | 1.044 | 1.019 |
| Example 8 | EA-8 | 16.6 | 15.9 | 15.5 | 1.044 | 1.026 |
| Example 9 | EA-9 | 16.3 | 16.0 | 15.7 | 1.019 | 1.019 |
| Comparative Example 1 | EB-1 | 16.3 | 15.6 | 15.2 | 1.045 | 1.026 |
| Comparative Example 2 | EB-2 | 16.3 | 15.9 | 15.2 | 1.025 | 1.046 (B) |
| Comparative Example 3 | EB-3 | 16.7 | 15.9 | 15.5 | 1.050 (B) | 1.026 |

TABLE 4

| | External | Charge amount [μC/g] | | | Charge amount change | |
|---|---|---|---|---|---|---|
| | Additive | $Q_L$ | $Q_N$ | $Q_H$ | $Q_L/Q_N$ | $Q_N/Q_H$ |
| Example 1 | EA-1 | 10.2 | 7.3 | 5.2 | 1.40 | 1.40 |
| Example 2 | EA-2 | 10.4 | 7.5 | 5.5 | 1.39 | 1.36 |
| Example 3 | EA-3 | 11.0 | 7.4 | 5.0 | 1.49 | 1.48 |
| Example 4 | EA-4 | 9.8 | 6.7 | 5.0 | 1.46 | 1.34 |
| Example 5 | EA-5 | 10.4 | 7.4 | 5.1 | 1.41 | 1.45 |
| Example 6 | EA-6 | 10.6 | 7.5 | 5.3 | 1.41 | 1.42 |
| Example 7 | EA-7 | 13.1 | 8.6 | 5.3 | 1.52 | 1.62 |
| Example 8 | EA-8 | 13.0 | 8.6 | 4.4 | 1.51 | 1.95 |
| Example 9 | EA-9 | 9.8 | 7.0 | 5.0 | 1.40 | 1.40 |
| Comparative Example 1 | EB-1 | 10.2 | 5.7 | 5.1 | 1.79 (B) | 1.12 |
| Comparative Example 2 | EB-2 | 10.1 | 9.0 | 5.1 | 1.12 | 1.76 |
| Comparative Example 3 | EB-3 | 13.2 | 8.7 | 4.3 | 1.52 | 2.02 (B) |

TABLE 5

| | External additive | Image density (ID) | | | ID change | |
|---|---|---|---|---|---|---|
| | | $ID_L$ | $ID_N$ | $ID_H$ | $ID_L/ID_N$ | $ID_N/ID_H$ |
| Example 1 | EA-1 | 1.30 | 1.25 | 1.21 | 1.040 | 1.033 |
| Example 2 | EA-2 | 1.31 | 1.28 | 1.24 | 1.023 | 1.032 |
| Example 3 | EA-3 | 1.32 | 1.27 | 1.21 | 1.039 | 1.050 |
| Example 4 | EA-4 | 1.27 | 1.21 | 1.21 | 1.050 | 1.000 |
| Example 5 | EA-5 | 1.30 | 1.25 | 1.21 | 1.040 | 1.033 |
| Example 6 | EA-6 | 1.32 | 1.28 | 1.24 | 1.031 | 1.032 |
| Example 7 | EA-7 | 1.34 | 1.26 | 1.22 | 1.063 | 1.033 |
| Example 8 | EA-8 | 1.30 | 1.23 | 1.17 | 1.057 | 1.051 |
| Example 9 | EA-9 | 1.26 | 1.25 | 1.20 | 1.008 | 1.042 |
| Comparative Example 1 | EB-1 | 1.30 | 1.19 | 1.21 | 1.092 (B) | 0.983 |
| Comparative Example 2 | EB-2 | 1.30 | 1.29 | 1.20 | 1.008 | 1.075 (B) |
| Comparative Example 3 | EB-3 | 1.34 | 1.24 | 1.17 | 1.081 (B) | 1.060 (B) |

Each of the external additives EA-1 to EA-9 (external additives of the respective toners of Examples 1 to 9) included a plurality of resin particles containing an external additive resin (specifically, a thermosetting epoxy resin), low TR domains (first temperature responsive polymer domains), and high TR domains (second temperature responsive polymer domains). The low TR domains and the high TR domains were dispersed in the external additive resin (specifically, the thermosetting epoxy resin). The high TR domains had a LCST (lower critical solution temperature) higher than that of the low TR domains (see Table 1). Electrostatic latent image developing toners each containing a corresponding one of the external additives EA-1 to EA-9 had the basic features.

As shown in Tables 3 to 5, the charge amount of each of the toners containing a corresponding one of the external additives EA-1 to EA-9 could be kept at an appropriate level in wide temperature range environments. Also, high-quality images could be formed continuously using any one of the electrostatic latent image developing toners containing a corresponding one of the external additives EA-1 to EA-9.

The external additive EB-1 (toner external additive of Comparative Example 1) was a powder of resin particles containing only one type of temperature responsive polymer domains (specifically, the temperature responsive polymer TR-3 having a LCST of 19° C.) (see Table 1). In a toner containing the external additive EB-1 as above, $Q_L/Q_N$ was large as shown in Table 4. Excessively large $Q_L/Q_N$ tends to cause image failure when environmental change between the normal-temperature and normal-humidity environment (NN environment) and the low-temperature and low-humidity environment (LL environment) occurs. When the external additive EB-1 was used, the toner was excessively charged in the printing durability test performed in the low-temperature and low-humidity environment (LL environment) (see Table 5).

The external additive EB-2 (toner external additive of Comparative Example 2) was a powder of resin particles containing only one type of temperature responsive polymer domains (specifically, the temperature responsive polymer TR-8 having a LCST of 26° C.) (see Table 1). In a toner containing the external additive EB-2 as above, $R_N/R_H$ was large as shown in Table 3. Excessively large $R_N/R_H$ tends to cause image failure when environmental change between the normal-temperature and normal-humidity environment (NN environment) and the high-temperature and high-humidity environment (HH environment) occurs. When the external additive EB-2 was used, the charge amount of the toner was significantly reduced in the printing durability test performed in the high-temperature and high-humidity environment (HH environment) (see Table 5).

The external additive EB-3 (toner external additive of Comparative Example 3) was a powder of resin particles containing no temperature responsive polymer (see Table 1). In a toner containing the external additive EB-3 as above, $R_L/R_N$ and $Q_N/Q_H$ were large as shown in Tables 3 and 4, respectively. Excessively large $R_L/R_N$ tends to cause image failure when environment change between the normal-temperature and normal-humidity environment (NN environment) and the low-temperature and low-humidity environment (LL environment) occurs. Excessively large $Q_N/Q_H$ tends to cause image failure when environmental change between the normal-temperature and normal-humidity environment (NN environment) and the high-temperature and high-humidity environment (HH environment) occurs. When the external additive EB-3 was used, the toner was excessively charged in the printing durability test performed in the low-temperature and low-humidity environment (LL environment) and the charge amount of the toner was significantly reduced in the printing durability test performed in the high-temperature and high-humidity environment (HH environment) (see Table 5).

What is claimed is:

1. An electrostatic latent image developing toner comprising a plurality of toner particles each including a toner mother particle and an external additive attached to a surface of the toner mother particle, wherein the external additive includes a plurality of resin particles each containing first temperature responsive polymer domains and second temperature responsive polymer domains, the second temperature responsive polymer domains have a lower critical solution temperature higher than that of the first temperature responsive polymer domains, the first temperature responsive polymer domains contain a polymer of monomers including acrylamide having an acetyl group at a position of a nitrogen atom and methacrylamide having an acetyl group at a position of a nitrogen atom, the second temperature responsive polymer domains contain a polymer of monomers including (meth)acrylamide having a straight chain alkyl group at a position of a nitrogen atom and (meth)acrylamide having a branched alkyl group at a position of a nitrogen atom, or a polymer of monomers including (meth)acrylamide having a cyclic ether group at a position of a nitrogen atom.

2. The electrostatic latent image developing toner according to claim 1, wherein the lower critical solution temperature of the first temperature responsive polymer domains is at least 13° C. and no greater than 20° C., and the lower critical solution temperature of the second temperature responsive polymer domains is at least 25° C. and no greater than 30° C.

3. The electrostatic latent image developing toner according to claim 1, wherein the second temperature responsive polymer domains contain a polymer of monomers including at least two types of temperature responsive monomers.

4. The electrostatic latent image developing toner according to claim 1, wherein the resin particles further contain a thermosetting resin, the first temperature responsive polymer domains and the second temperature responsive polymer domains are dispersed in the thermosetting resin, and the resin particles have a number average primary particle diameter of at least 10 nm and no greater than 150 nm.

5. The electrostatic latent image developing toner according to claim 4, wherein a difference in the lower critical solution temperature between the first temperature responsive polymer domains and the second temperature responsive polymer domains is at least 5° C. and no greater than 20° C., and an amount of the first temperature responsive polymer domains and that of the second temperature responsive polymer domains each are at least 10% by mass and no greater than 20% by mass relative to a total mass of the thermosetting resin, the first temperature responsive polymer domains, and the second temperature responsive polymer domains.

6. A toner external additive comprising a plurality of resin particles each containing first temperature responsive polymer domains and second temperature responsive polymer domains, wherein the second temperature responsive polymer domains have a lower critical solution temperature higher than that of the first temperature responsive polymer domains, the first temperature responsive polymer domains contain a polymer of monomers including acrylamide having an acetyl group at a position of a nitrogen atom and methacrylamide having an acetyl group at a position of a nitrogen atom, and the second temperature responsive polymer domains contain a polymer of monomers including (meth)acrylamide having a straight chain alkyl group at a position of a nitrogen atom and (meth)acrylamide having a branched alkyl group at a position of a nitrogen atom, or a polymer of monomers including (meth)acrylamide having a cyclic ether group at a position of a nitrogen atom.

* * * * *